US010569404B2

(12) United States Patent
Comarmond

(10) Patent No.: US 10,569,404 B2
(45) Date of Patent: Feb. 25, 2020

(54) PERCUSSION APPARATUS

(71) Applicant: MONTABERT, Saint-Priest (FR)

(72) Inventor: Jean-Sylvain Comarmond, Vourles (FR)

(73) Assignee: MONTABERT, Saint-Priest (FR)

( * ) Notice: Subject to any disclaimer, the term of this patent is extended or adjusted under 35 U.S.C. 154(b) by 370 days.

(21) Appl. No.: 15/522,667

(22) PCT Filed: Oct. 16, 2015

(86) PCT No.: PCT/FR2015/052785

§ 371 (c)(1),
(2) Date: Apr. 27, 2017

(87) PCT Pub. No.: WO2016/066922

PCT Pub. Date: May 6, 2016

(65) Prior Publication Data

US 2017/0312901 A1 Nov. 2, 2017

(30) Foreign Application Priority Data

Oct. 28, 2014 (FR) ..... 14 60342

(51) Int. Cl.
*B25D 9/26* (2006.01)
*B25D 9/14* (2006.01)
(Continued)

(52) U.S. Cl.
CPC ..... *B25D 9/26* (2013.01); *B25D 9/145* (2013.01); *B25D 9/18* (2013.01); *B25D 9/20* (2013.01); *B25D 2209/007* (2013.01)

(58) Field of Classification Search
CPC ... B25D 9/26; B25D 9/18; B25D 9/14; B25D 9/145; B25D 9/16; B25D 2209/005;
(Continued)

(56) References Cited

U.S. PATENT DOCUMENTS 4,413,687 A * 11/1983 Eklof ..... B25D 9/12 173/207
4,800,797 A * 1/1989 Comarmond ..... B25D 9/145 91/307

(Continued)

FOREIGN PATENT DOCUMENTS

FR 2595972 A2 9/1987

OTHER PUBLICATIONS

FR2595972 Abstract.

(Continued)

*Primary Examiner* — Hemant Desai
*Assistant Examiner* — Veronica Martin
(74) *Attorney, Agent, or Firm* — Cantor Colburn LLP

(57) ABSTRACT

This percussion apparatus includes a striking piston, a control distributor arranged to control a reciprocating movement of the striking piston, and a control device arranged to vary the striking stroke of the striking piston. The control device comprises a plurality of control channels, a control channel connected to the control distributor, a control slide movably mounted between a plurality of control positions, and an adjusting slide mounted in a receiving housing delimited by the control slide, the control slide and the adjusting slide delimiting a first adjusting chamber connected to the control channel and a second adjusting chamber connected to a the high-pressure fluid supply circuit. The control slide is movably mounted between a first position in which the first control chamber and the second adjusting chamber are connected and a second position in which the first control chamber and the second adjusting chamber are isolated.

20 Claims, 3 Drawing Sheets

(51) Int. Cl.
*B25D 9/18* (2006.01)
*B25D 9/20* (2006.01)

(58) Field of Classification Search
CPC .... E21B 4/14; E21B 21/01; Y10T 137/87169; Y10T 137/86702
USPC ..... 173/138, 207, 206, 135, 136; 91/278; 137/596, 625.68
See application file for complete search history.

(56) References Cited

U.S. PATENT DOCUMENTS

| | | | | |
|---|---|---|---|---|
| 5,392,865 | A * | 2/1995 | Piras | B25D 9/145 173/137 |
| 5,669,281 | A * | 9/1997 | Comarmond | B25D 9/26 91/245 |
| 6,371,222 | B1 * | 4/2002 | Andersson | B25D 9/145 173/136 |
| 8,069,928 | B2 * | 12/2011 | Birath | B25D 9/16 173/1 |
| 8,739,986 | B2 * | 6/2014 | Preidt | A47F 5/00 108/187 |
| 2009/0095498 | A1 * | 4/2009 | Andersson | B25D 9/20 173/206 |
| 2009/0321099 | A1 | 12/2009 | Birath | |

OTHER PUBLICATIONS

FR2595972 English Translation of Specificaiton and Claims.
International Search Report for Application No. PCT/FR2015/052785.

* cited by examiner

PERCUSSION APPARATUS

CROSS REFERENCE TO RELATED APPLICATIONS

This application is a National Phase Application of Patent Application PCT/FR2015/052785 filed on Oct. 16, 2015, which claims the benefit of and priority to French Patent Application 14/60342 filed on Oct. 28, 2014, the contents each of which are incorporated herein by reference in their entirety.

TECHNICAL FIELD

The present invention concerns a percussion apparatus, and more particularly a percussion hydraulic apparatus.

BACKGROUND

The document FR2595972 discloses a percussion apparatus, including:

- a body delimiting a piston cylinder,
- a striking piston alternately movable inside the piston cylinder, and arranged to strike a tool during each operating cycle of the percussion apparatus,
- a control distributor arranged to control a reciprocating movement of the striking piston inside the piston cylinder reciprocally along a striking stroke and a return stroke,
- a control device arranged to vary the striking stroke of the striking piston depending on the hardness of the ground encountered by the tool, the control device comprising:
- a control cylinder,
- a plurality of control channels each opening into the control cylinder, each control channel also opening into the piston cylinder and being adapted to be put in communication with a high-pressure fluid supply circuit during at least one part of the reciprocating movement of the striking piston,
- a control channel connected to the control distributor and opening into the control cylinder,
- a control slide movably mounted in the control cylinder between a plurality of control positions in each of which the control slide is configured to fluidly connect the control channel with at least one of the control channels,
- a first control chamber delimited by the control slide and the control cylinder, a first face of the control slide being located in the first control chamber, and
- a second control chamber delimited by the control slide and the control cylinder and permanently connected to a low-pressure return circuit, a second face of the control slide, opposite to the first face, being located in the second control chamber.

The control device further comprises a flow regulating member, formed by a volumetric pump, actuated in synchronisation with the striking piston. The flow regulating member is shaped to ensure the intake, at each operating cycle of the percussion apparatus, of a predetermined amount of fluid in the first control chamber.

The control device also comprises a discharge channel opening respectively into the piston cylinder and into the first control chamber, the discharge channel being configured to be put in communication with the low-pressure return circuit, via a peripheral groove provided on the striking piston and a connecting channel permanently connected to the low-pressure return circuit and opening into the piston cylinder, when the striking piston is in and/or close to a theoretical striking position.

The discharge channel is configured to discharge, at each operating cycle of the percussion apparatus, an amount of fluid out of the first control chamber, which depends on the residence time of the striking piston in and/or close to the theoretical striking position thereof and therefore on the hardness of the ground encountered by the tool. These dispositions allow adjusting the position of the control slide and accordingly the length of the striking stroke of the striking piston depending on the hardness of the ground encountered by the tool.

A drawback of such a percussion apparatus lies in the complexity of the production of the volumetric pump. Indeed, such a volumetric pump requires the production of rectified slides and bores, implanted in one or more heavy and expensive part(s).

The present invention aims to overcome these drawbacks.

BRIEF SUMMARY

Therefore, the technical problem underlying the invention consists in providing a percussion apparatus including a control device of simple and economical structure, while allowing automatically adapting the length of the striking stroke of the striking piston depending on the hardness of the ground in which the percussions are generated.

To this end, the present invention concerns a percussion apparatus, including:

- a body delimiting a piston cylinder,
- a striking piston mounted movable, in a reciprocating manner, inside the piston cylinder, and arranged to strike a tool during each operating cycle of the percussion apparatus,
- a control distributor arranged to control a reciprocating movement of the striking piston inside the piston cylinder reciprocally along a striking stroke and a return stroke,
- a control device arranged to vary the striking stroke of the striking piston depending on the hardness of the ground encountered by the tool, the control device comprising:
- a control cylinder,
- a plurality of control channels each opening into the control cylinder, each control channel also opening into the piston cylinder and being adapted to be put in communication with a high-pressure fluid supply circuit during at least one part of the reciprocating movement of the striking piston,
- a control channel connected to the control distributor and opening into the control cylinder,
- a control slide movably mounted in the control cylinder between a plurality of control positions in each of which the control slide is configured to fluidly connect the control channel with at least one of the control channels,
- a first control chamber delimited by the control slide and the control cylinder, a first face of the control slide being located in the first control chamber, and
- a second control chamber delimited by the control slide and the control cylinder, a second face of the control slide, opposite to the first face, being located in the second control chamber, the control slide delimits a receiving housing, in that the control device further comprises an adjusting slide mounted in the receiving housing, the control slide and the adjusting slide delimiting a first adjusting chamber permanently fluidly connected to the control channel and a second adjusting chamber permanently fluidly connected to the high-pressure fluid supply circuit, and in that the adjusting slide is movably mounted in the receiving housing between a first position in which the adjusting slide is configured to fluidly connect the first control chamber and the second adjusting chamber and a second position in which the adjusting slide is configured to fluidly isolate the first control chamber and the second adjusting chamber, the control device being configured such that the adjusting slide is displaced towards the first position thereof when the control channel is fluidly connected to the high-pressure fluid supply circuit via at least one of the control channels.

Thus, the adjusting slide is configured to supply, at each operating cycle of the percussion apparatus, the first control chamber with a predetermined quantity of high-pressure fluid, without the need for the presence of a complex flow regulating member, such as a volumetric pump.

Furthermore, since the first adjusting chamber is permanently fluidly connected to the control channel, the control device is configured such that the adjusting slide is actuated in synchronisation with the control distributor. Hence, the adjusting slide is configured to operate at the same frequency as the striking piston.

The percussion apparatus may further have one or more of the following features, taken alone or in combination.

According to an embodiment of the invention, the control slide and the adjusting slide delimit a second adjusting chamber permanently fluidly connected to the high-pressure fluid supply circuit, the adjusting slide being configured to fluidly isolate the first control chamber and the second adjusting chamber when the adjusting slide is in the second position thereof, and to fluidly connect the first control chamber and the second adjusting chamber when the adjusting slide is in the first position thereof.

According to an embodiment of the invention, the adjusting slide is slidably mounted in the receiving housing.

According to an embodiment of the invention, the adjusting slide comprises an end face located in the first adjusting chamber.

According to an embodiment of the invention, the control cylinder and the control slide delimit an annular outer chamber permanently connected to the high-pressure fluid supply circuit, the control slide comprising a connecting passage configured to fluidly connect the annular outer chamber and the second adjusting chamber.

According to an embodiment of the invention, each of the control channels includes a first end opening into the piston cylinder and a second end opening into the control cylinder, the first ends of the control channels being shifted along the extension direction of the striking piston, and the second ends of the control channels being shifted along the extension direction of the control slide.

According to an embodiment of the invention, the control device is configured such that the adjusting slide is displaced towards the second position thereof when the control channel is fluidly isolated from the high-pressure fluid supply circuit.

According to an embodiment of the invention, the adjusting slide comprises a supply passage fluidly connected to the first control chamber, the adjusting slide being configured such that the supply passage is fluidly isolated from the second adjusting chamber when the adjusting slide is in the second position thereof, and such that the supply passage is fluidly connected to the second adjusting chamber when the adjusting slide is in the first position thereof.

According to an embodiment of the invention, the control channel also opens into the piston cylinder, and is configured to be put in communication with a low-pressure return circuit during at least one part of the reciprocating movement of the striking piston.

According to an embodiment of the invention, the control device is configured such that the adjusting slide is displaced towards the second position thereof when the control channel is fluidly connected to the low-pressure return circuit.

According to an embodiment of the invention, the control channel is configured to be put in communication with the low-pressure return circuit during at least one part of the striking stroke of the striking piston or when the striking piston is in and/or close to a theoretical striking position.

According to an embodiment of the invention, the percussion apparatus comprises a connecting channel permanently connected to the low-pressure return circuit and opening into the piston cylinder, the striking piston including a peripheral groove configured to fluidly connect said connecting channel and the control channel during at least one part of the striking stroke of the striking piston, and for example at the end of the striking stroke, or when the striking piston is in and/or close to a theoretical striking position.

According to an embodiment of the invention, the control slide comprises a peripheral control groove, the peripheral control groove and the control cylinder delimiting an annular connecting chamber into which the control channel opens, the annular connecting chamber being configured to fluidly connect the control channel with at least one of the control channels depending on the control position occupied by the control slide.

According to an embodiment of the invention, the control slide comprises a connecting orifice configured to fluidly connect the annular connecting chamber and the first adjusting chamber.

According to an embodiment of the invention, the connecting orifice opens respectively into the first adjusting chamber and into the bottom of the peripheral control groove.

According to an embodiment of the invention, each control channel is adapted to be put in communication with the high-pressure fluid supply circuit during at least one part of the return stroke of the striking piston.

According to an embodiment of the invention, the control device comprises a discharge channel opening respectively into the piston cylinder and into the first control chamber, the discharge channel being configured to be put in communication with the low-pressure return circuit when the striking piston is in and/or close to a theoretical striking position.

Thus, the discharge channel is configured to discharge, at each operating cycle of the percussion apparatus, an amount of fluid out of the first control chamber.

According to an embodiment of the invention, the percussion apparatus comprises a connecting channel permanently connected to the low-pressure return circuit and opening into the piston cylinder, the striking piston including a peripheral groove configured to fluidly connect the connecting channel and the discharge channel when the striking piston is in and/or close to a theoretical striking position.

According to an embodiment of the invention, the discharge channel is provided with a calibrated orifice.

According to an embodiment of the invention, the striking piston and the piston cylinder delimit a first control chamber permanently connected to the high-pressure fluid supply circuit and a second control chamber, the control distributor being configured to alternately connect the second control chamber with the high-pressure fluid supply circuit and the low-pressure return circuit.

According to an embodiment of the invention, each control channel is configured to be put in communication with the first control chamber during at least one part of the reciprocating movement of the striking piston, and for example during at least one part of the return stroke of the striking piston.

According to an embodiment of the invention, the second control chamber is permanently connected to the low-pressure return circuit.

According to an embodiment of the invention, the control device comprises a connecting channel permanently connected to the low-pressure return circuit and opening into the second control chamber.

According to an embodiment of the invention, the control slide comprises a retaining member configured to retain the adjusting slide in the receiving housing.

According to an embodiment of the invention, the retaining member delimits at least partially the first control chamber and is configured to limit the displacement stroke of the adjusting slide towards the first control chamber.

According to an embodiment of the invention, the adjusting slide comprises a tubular portion delimiting at least partially the supply passage, the retaining member extending around the tubular portion.

According to an embodiment of the invention, the retaining member comprises a stop surface against which the adjusting slide is adapted to bear in the first position thereof.

According to an embodiment of the invention, the control channel is connected to a control chamber of the control distributor.

BRIEF DESCRIPTION OF THE DRAWINGS

In any case, the invention will be well understood using the following description with reference to the appended schematic drawing representing, by way of non-limiting example, an embodiment of this percussion apparatus.

DETAILED DESCRIPTION

Figure 1:
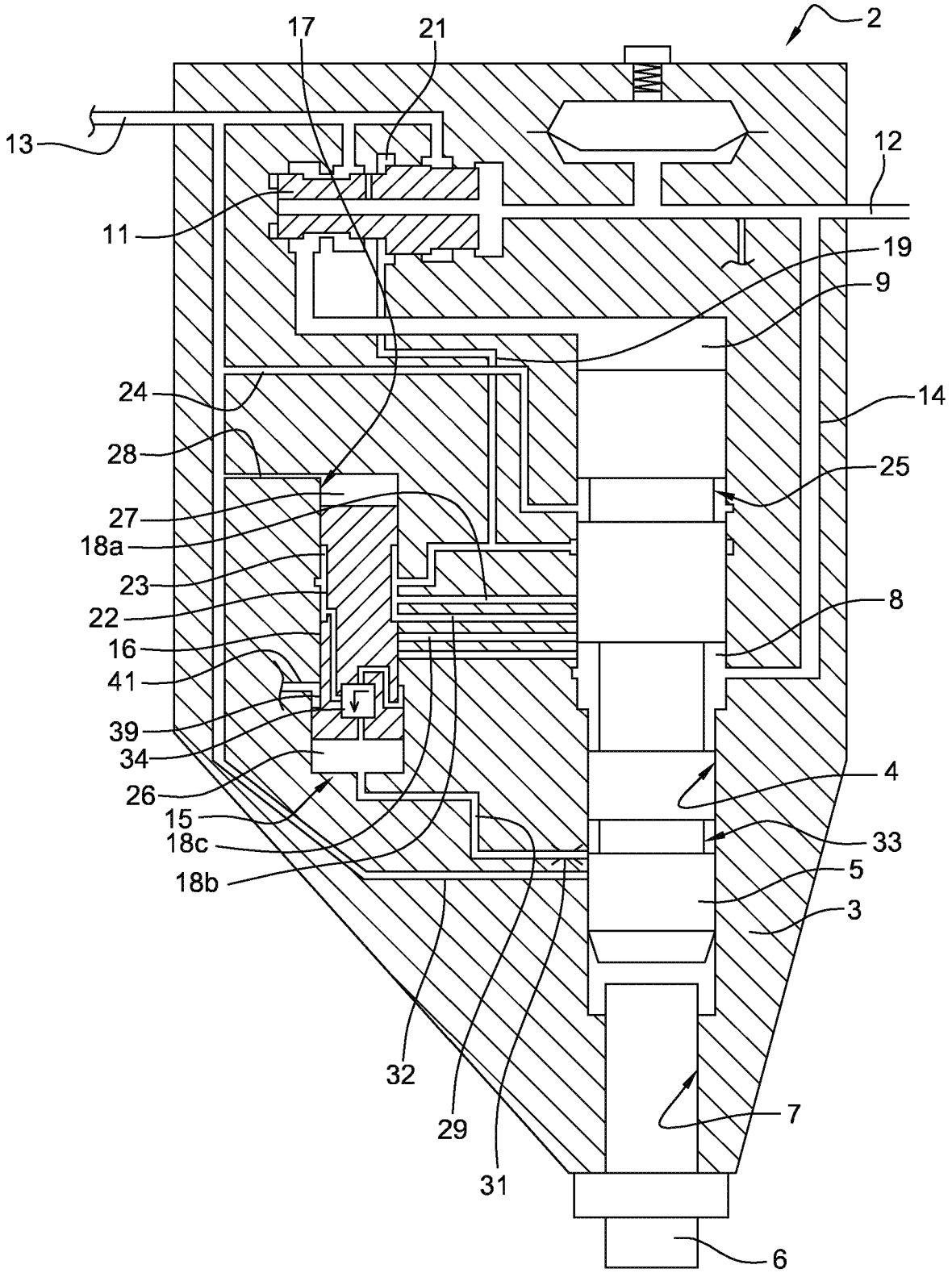
FIG. 1 is a longitudinal sectional schematic view of a percussion apparatus according to the invention.
Figure 2:
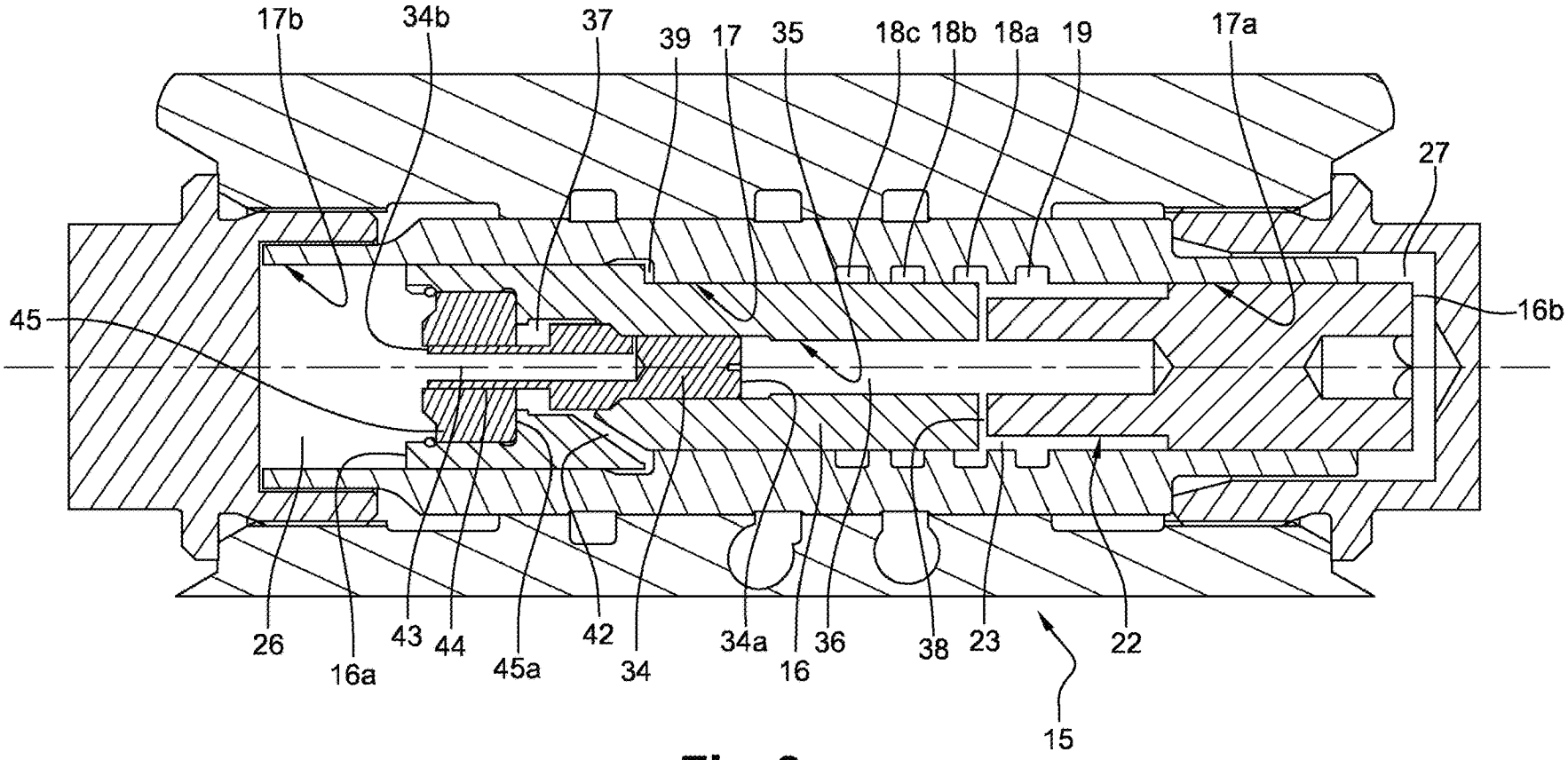
FIGS. 2 and 3 are longitudinal sectional views of a control device of the percussion apparatus of FIG. 1 in two different operating positions.
Figure 3:
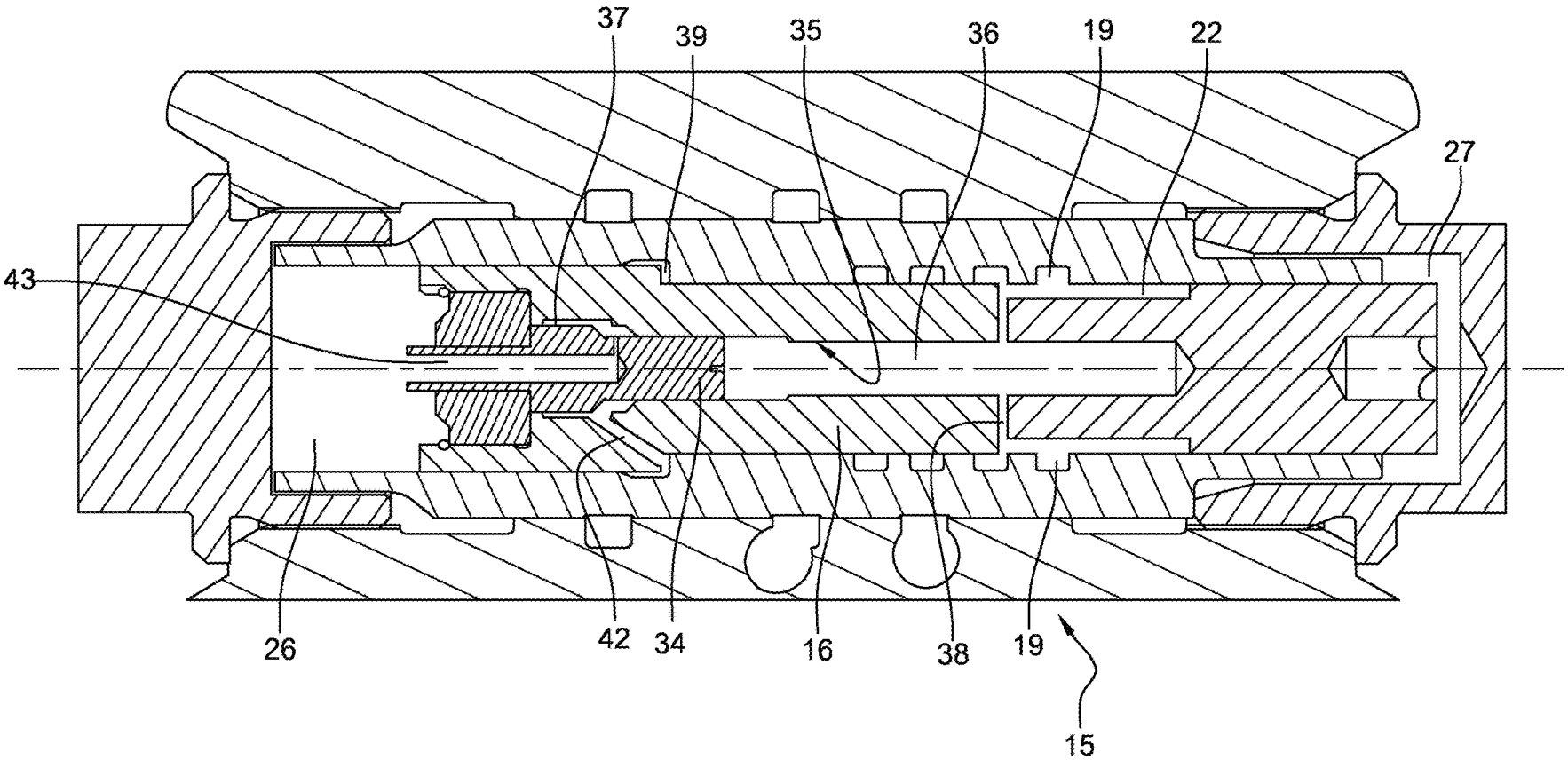

The percussion apparatus 2 represented in FIGS. 1 to 3 comprises a body 3 delimiting a piston cylinder 4, and a stepped striking piston 5 slidably mounted in a reciprocating manner inside the piston cylinder 4. During each operating cycle, the striking piston 5 is intended to strike against the upper end of a tool 6 slidably mounted in a bore 7 formed in the body 3 coaxially to the piston cylinder 4.

The striking piston 5 and the piston cylinder 4 delimit a first annular control chamber 8, called lower chamber, and a second control chamber 9, called upper chamber, of larger section disposed above the striking piston 5.

The percussion apparatus 2 further comprises a control distributor 11 arranged to control a reciprocating movement of the striking piston 5 inside the piston cylinder 4 reciprocally along a striking stroke and a return stroke. The control distributor 11 is configured to alternately connect the second control chamber 9 with a high-pressure fluid supply circuit 12 during the striking stroke of the striking piston 5, and with a low-pressure return circuit 13 during the return stroke of the striking piston 5.

The control distributor 11 is more particularly movably mounted in a bore formed in the body 3 between a first position (see FIG. 1) in which the control distributor 11 is configured to put the second control chamber 9 in connection with the low-pressure return circuit 13 and a second position in which the control distributor 11 is configured to put the second control chamber 9 in connection with the high-pressure fluid supply circuit 12.

The first control chamber 8 is permanently supplied with a high pressure fluid by a connecting channel 14, so that each position of the control distributor 11 causes the striking stroke of the striking piston 5, then the return stroke of the striking piston 5. The connecting channel 14 may advantageously be connected to an accumulator.

The percussion apparatus 2 also comprises a control device 15 arranged to vary the striking stroke of the striking piston 5 between a short striking stroke and a long striking stroke and vice versa, depending on the hardness of the soil encountered by the tool 6.

The control device 15 comprises a control slide 16 mounted in a control cylinder 17 formed in the body 3. The control cylinder 17 is stepped, and comprises a first portion 17*a* and a second portion 17*b* having a section greater than that of the first part 17*a*.

The control device 15 further comprises a plurality of control channels 18*a*, 18*b*, 18*c* arranged to drive different lengths of striking stroke. Each control channel 18*a*, 18*b*, 18*c* opens respectively into the control cylinder 17 and into the piston cylinder 4. The ends of the control channels 18*a*, 18*b*, 18*c* opening into the piston cylinder 4 are shifted along the extension direction of the striking piston 5, while the ends of the control channels 18*a*, 18*b*, 18*c* opening into the control cylinder 17 are shifted along the extension direction of the control slide 16. As shown in FIG. 1, the control device 15 may, for example, comprise four control channels and therefore allow adjusting four different lengths of striking stroke. However, the control device 15 might comprise less than four or more than four control channels. For example, as shown in FIGS. 2 and 3, the control device 15 might, for example, comprise three control channels.

Each control channel 18*a*, 18*b*, 18*c* is capable of being put in communication with the first control chamber 8, and therefore with the high-pressure fluid supply circuit 12, during at least a part of the return stroke of the striking piston 5.

The control device 15 also comprises a control channel 19 fluidly connected to a control chamber 21 of the control distributor 11. The control channel 19 opens, on the one hand, into the control cylinder 17 and, on the other hand, into the piston cylinder 4.

The control slide 16 is slidably mounted in the control cylinder 17 between a plurality of control positions in each of which the control slide 16 is configured to fluidly connect the control channel 19 with at least one of the control channels 18*a*, 18*b*, 18*c*.

According to the embodiment represented in the figures, the control slide 16 comprises a peripheral control groove 22. The peripheral control groove 22 and the control cylinder 17 delimit an annular connecting chamber 23 into which the control channel 19 opens. The connecting chamber 23 is more particularly configured to fluidly connect the control channel 19 with at least one of the control channels 18*a*, 18*b*, 18*c* depending on the control position occupied by the control slide 16. Thus, the control channel 19 is configured to be put in communication with the high-pressure fluid supply circuit 12, via at least one of the control channels 18*a*, 18*b*, 18*c*, during at least one part of the return stroke of the striking piston.

The control channel 19 is also configured to be put in communication with the low-pressure return circuit 13 when the striking piston 5 is in and/or close to a theoretical striking position.

According to the embodiment represented in the figures, the percussion apparatus 2 comprises a connecting channel 24 permanently connected to the low-pressure return circuit 13 and opening into the piston cylinder 4, and the striking piston 5 includes a peripheral groove 25 configured to fluidly connect the connecting channel 24 and the control channel 19 when the striking piston 5 is in and/or close to a theoretical striking position.

The percussion apparatus 2 is configured such that the control distributor 11 is displaced towards the first position thereof when the control chamber 21 and the control channel 19 are connected to the low-pressure return circuit 13 and towards the second position thereof when the control chamber 21 and the control channel 19 are connected to the high-pressure fluid supply circuit 12.

The control slide 16 and the control cylinder 17 delimit a first control chamber 26 in which a first face 16*a* of the control slide 16 is located, and a second control chamber 27 in which a second face 16*b* of the control slide 16 is located opposite the first face 16*a*. The second control chamber 27 is permanently connected to the low-pressure return circuit 13 by a connecting channel 28.

The control device 15 further comprises a discharge channel 29 provided with a calibrated orifice 31. The discharge channel 29 opens respectively into the piston cylinder 4 and into the first control chamber 26, and is configured to be put in communication with the low-pressure return circuit 13 when the striking piston 5 is in and/or close to the theoretical striking position thereof. To this end, the percussion apparatus 2 includes a connecting channel 32 permanently connected to the low-pressure return circuit 13 and opening into the piston cylinder 4, and the striking piston 5 including a peripheral groove 33 configured to fluidly connect the connecting channel 32 and the discharge channel 29 when the striking piston 5 is in and/or close to a theoretical striking position, and in particular when the striking piston 5 is bearing on the tool 6. According to the embodiment represented in the figures, the end of the discharge channel 29 opening into the piston cylinder 4 is configured to be closed by an outer wall of the striking piston 5 when said striking piston is positioned at a distance from the theoretical striking position thereof.

The control device 15 also comprises an adjusting slide 34 slidably mounted in a longitudinal receiving housing 35, and advantageously axial, delimited by the control slide 16. The control slide 16 and the adjusting slide 34 delimit a first adjusting chamber 36 permanently fluidly connected to the control channel 19 and in which an end face 34*a* of the adjusting slide 34 is located. The control slide 16 and the adjusting slide 34 further delimit a second adjusting chamber 37 permanently fluidly connected to the high-pressure fluid supply circuit 12. According to the embodiment represented in the figures, the second adjusting chamber 37 is annular.

According to the embodiment represented in the figures, the control slide 16 includes a connecting orifice 38 configured to fluidly connect the connecting chamber 23 and the first adjusting chamber 36. The connecting orifice 38 advantageously opens respectively into the first adjusting chamber 36 and into the bottom of the peripheral control groove 22.

According to the embodiment represented in the figures, the second part 17*b* of the control cylinder 17 and the control slide 16 delimits an outer annular chamber 39 permanently connected to the high-pressure fluid supply circuit 12 by a connecting channel 41, and the control slide 16 comprises a connecting passage 42 configured to fluidly connect the annular outer chamber 39 and the second adjusting chamber 37. The connecting passage 42 comprises, for example, a first end opening into the second adjusting chamber 37 and a second end opening into the annular outer chamber 39.

The outer chamber 39 being delimited by the second portion 17*b* of large section of the control cylinder 17, the force exerted by the high-pressure fluid on the control slide 16 tends to displace said control slide in a direction of volume decrease of the first adjusting chamber 26.

The adjusting slide 34 further comprises a supply passage 43 fluidly connected to the first control chamber 26. According to the embodiment represented in the figures, the supply passage 43 includes a first end axially opening into the end face 34*b* of the adjusting slide 34 facing the first control chamber 26, and a second end opening radially into a lateral wall of the adjusting slide 34.

According to the embodiment represented in the figures, the adjusting slide 34 comprises a tubular portion 44 partially delimiting the supply passage 43, and the control slide 16 comprises a retaining ring 45 extending around the tubular portion 44 and configured to retain the adjusting slide 34 in the receiving housing 35. The retaining ring 45 is configured to limit the displacement stroke of the adjusting slide 34 towards the first control chamber 26, and comprises for example a stop surface 45*a* against which the adjusting slide 34 is capable of bearing in the first position thereof.

The adjusting slide 34 is slidably mounted in the receiving housing 35 between a first position in which the supply passage 43 is fluidly connected to the second adjusting chamber 37 (see FIG. 3), and a second position in which the supply passage 43 is fluidly isolated from the second adjusting chamber 37 (see FIG. 2). In the second position of the adjusting slide 34, the second end of the supply passage 43 is closed by an inner wall of the control slide 16 partially delimiting the receiving housing 35.

The adjusting slide 34 is more particularly configured to be displaced towards the first position thereof when the control channel 19 is fluidly connected to the high-pressure fluid supply circuit 12 via at least one of the control channels 18*a*, 18*b*, 18*c*, and to be displaced towards the second position thereof when the control channel 19 is fluidly connected to the low-pressure return circuit 13 via the peripheral groove 25 and the connecting channel 24.

The control slide 16 has a substantially stable position when the quantity of fluid extracted, per cycle, from the first adjusting chamber 26 through the discharge channel 29, is equal to the quantity of fluid injected, per cycle, in the first adjusting chamber 26 by the supply passage 43.

If the ground encountered by the tool 6 becomes softer, the residence time of the striking piston 5 in and/or close to the theoretical stroke position thereof increases, as well as the time during which the first adjusting chamber 26 is put in communication with the low-pressure return circuit 13 via the discharge channel 29 and the peripheral groove 33. Hence, the quantity of fluid extracted from the first adjusting chamber 26 becomes greater than the quantity of fluid injected in the first adjusting chamber 26 by the supply passage 43. This results in a displacement of the control slide 16 in a direction of the volume decrease of the first adjusting chamber 26 under the action of the supply pressure in the outer chamber 39, which is reflected in an action on the control distributor 11 which decreases the striking stroke of the striking piston 5.

On the contrary, if the ground becomes harder, the quantity of fluid extracted from the first adjusting chamber 26, taking into account the short residence time of the striking piston 5 in contact with the tool 6, becomes lower than the quantity of intake fluid in the first adjusting chamber 26 by the supply passage 43. The control slide 16 is displaced therefore in a direction of the volume increase of the first adjusting chamber 26, which is reflected in an action on the control distributor 11 so that said control distributor increases the striking stroke of the striking piston 5.

It is noteworthy that the balance of the control slide 16 is obtained without spring under the action, on the one hand, of the fluid pressure inside the first adjusting chamber 26 and, on the other hand, of the supply pressure inside the outer chamber 39.

Of course, the invention is not limited to the sole embodiment of this percussion apparatus, described above by way of example, it encompasses, on the contrary, all the variants thereof.

The invention claimed is:

1. A percussion apparatus, including:

a body delimiting a piston cylinder, a striking piston alternately movable inside the piston cylinder, and arranged to strike a tool during each operating cycle of the percussion apparatus, a control distributor arranged to control a reciprocating movement of the striking piston inside the piston cylinder reciprocally along a striking stroke and a return stroke, a control device arranged to vary the striking stroke of the striking piston depending on the hardness of the ground encountered by the tool, the control device comprising:

a control cylinder, a plurality of first control channels each opening into the control cylinder, each first control channel also opening into the piston cylinder and being adapted to be put in communication with a high-pressure fluid supply circuit during at least one part of the reciprocating movement of the striking piston, a second control channel connected to the control distributor and opening into the control cylinder, a control slide movably mounted in the control cylinder between a plurality of control positions in each of which the control slide is configured to fluidly connect the second control channel with at least one of the first control channels, a first control chamber delimited by the control slide and the control cylinder, a first face of the control slide being located in the first control chamber, and a second control chamber delimited by the control slide and the control cylinder, a second face of the control slide, opposite to the first face, being located in the second control chamber, wherein the control slide delimits a receiving housing, the control device further comprises an adjusting slide mounted in the receiving housing, the control slide and the adjusting slide delimiting a first adjusting chamber permanently fluidly connected to the second control channel and a second adjusting chamber permanently fluidly connected to the high-pressure fluid supply circuit, and the adjusting slide is movably mounted in the receiving housing between a first position in which the adjusting slide is configured to fluidly connect the first control chamber and the second adjusting chamber and a second position in which the adjusting slide is configured to fluidly isolate the first control chamber and the second adjusting chamber, the control device being configured such that the adjusting slide is displaced towards the first position thereof when the second control channel is fluidly connected to the high-pressure fluid supply circuit via at least one of the first control channels.

2. The percussion apparatus according to claim 1, wherein the adjusting slide comprises a supply passage fluidly connected to the first control chamber, the adjusting slide being configured such that the supply passage is fluidly connected to the second adjusting chamber when the adjusting slide is in the first position thereof, and such that the supply passage is fluidly isolated from the second adjusting chamber when the adjusting slide is in the second position thereof.

3. The percussion apparatus according to claim 1, wherein the control cylinder and the control slide delimit an annular outer chamber permanently connected to the high-pressure fluid supply circuit, the control slide comprising a connecting passage configured to fluidly connect the annular outer chamber and the second adjusting chamber.

4. The percussion apparatus according to claim 1, wherein the second control channel also opens into the piston cylinder, and is configured to be put in communication with a low-pressure return circuit during at least a part of the reciprocating movement of the striking piston.

5. The percussion apparatus according to claim 4, wherein the control device comprises a discharge channel opening respectively into the piston cylinder and into the first control chamber, the discharge channel being configured to be put in communication with the low-pressure return circuit when the striking piston is in a theoretical striking position.

6. The percussion apparatus according to claim 5, which comprises a connecting channel permanently connected to the low-pressure return circuit and opening into the piston cylinder, the striking piston including a peripheral groove configured to fluidly connect the connecting channel and the discharge channel when the striking piston is in the theoretical striking position.

7. The percussion apparatus according to claim 5, wherein the discharge channel is provided with a calibrated orifice.

8. The percussion apparatus according to claim 4, wherein the striking piston and the piston cylinder delimit a first controlling chamber permanently connected to the high-pressure fluid supply circuit and a second controlling chamber, the control distributor being configured to alternately connect the second controller chamber with the high-pressure fluid supply circuit and the low-pressure return circuit.

9. The percussion apparatus according to claim 4, wherein the second control chamber is permanently connected to the low-pressure return circuit.

10. The percussion apparatus according to claim 1, wherein the control slide comprises a peripheral control groove, the peripheral control groove and the control cylinder delimiting an annular connecting chamber into which the second control channel opens, the annular connecting chamber being configured to fluidly connect the second control channel with at least one of the first control channels depending on the control position occupied by the control slide.

11. The percussion apparatus according to claim 10, wherein the control slide comprises a connecting orifice configured to fluidly connect the annular connecting chamber and the first adjusting chamber.

12. The percussion apparatus according to claim 2, wherein the control cylinder and the control slide delimit an annular outer chamber permanently connected to the high-pressure fluid supply circuit, the control slide comprising a connecting passage configured to fluidly connect the annular outer chamber and the second adjusting chamber.

13. The percussion apparatus according to claim 2, wherein the second control channel also opens into the piston cylinder, and is configured to be put in communication with a low-pressure return circuit during at least a part of the reciprocating movement of the striking piston.

14. The percussion apparatus according to claim 3, wherein the second control channel also opens into the piston cylinder, and is configured to be put in communication with a low-pressure return circuit during at least a part of the reciprocating movement of the striking piston.

15. The percussion apparatus according to claim 12, wherein the second control channel also opens into the piston cylinder, and is configured to be put in communication with a low-pressure return circuit during at least a part of the reciprocating movement of the striking piston.

16. The percussion apparatus according to claim 13, wherein the control device comprises a discharge channel opening respectively into the piston cylinder and into the first control chamber, the discharge channel being configured to be put in communication with the low-pressure return circuit when the striking piston is theoretical striking position.

17. The percussion apparatus according to claim 16, which comprises a connecting channel permanently connected to the low-pressure return circuit and opening into the piston cylinder, the striking piston including a peripheral groove configured to fluidly connect the connecting channel and the discharge channel when the striking piston is the theoretical striking position.

18. The percussion apparatus according to claim 17, wherein the discharge channel is provided with a calibrated orifice.

19. The percussion apparatus according to claim 16, wherein the striking piston and the piston cylinder delimit a first control chamber permanently connected to the high-pressure fluid supply circuit and a second control chamber, the control distributor being configured to alternately connect the second control chamber with the high-pressure fluid supply circuit and the low-pressure return circuit.

20. The percussion apparatus according to claim 17, wherein the control slide comprises a peripheral control groove, the peripheral control groove and the control cylinder delimiting an annular connecting chamber into which the second control channel opens, the annular connecting chamber being configured to fluidly connect the second control channel with at least one of the first control channels depending on the control position occupied by the control slide.

* * * * *